US006305365B1

(12) United States Patent
Maeoka et al.

(10) Patent No.: US 6,305,365 B1
(45) Date of Patent: Oct. 23, 2001

(54) IGNITION APPARATUS

(75) Inventors: Tatsuo Maeoka, Kobe; Yoshimasa Yabu, Sakai, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/152,373

(22) Filed: Sep. 14, 1998

(30) Foreign Application Priority Data

Sep. 17, 1997 (JP) ..... 9-251977

(51) Int. Cl.[7] ..... F02P 3/06
(52) U.S. Cl. ..... 123/604; 123/620
(58) Field of Search ..... 123/604, 605, 123/609, 620

(56) References Cited

U.S. PATENT DOCUMENTS

| | | | | |
|---|---|---|---|---|
| 4,109,631 | * | 8/1978 | Miyao | 123/604 |
| 4,967,718 | * | 11/1990 | Scarnera | 123/604 |
| 5,220,901 | * | 6/1993 | Morita et al. | 123/620 |
| 5,456,241 | | 10/1995 | Ward | 173/598 |
| 5,558,071 | | 9/1996 | Ward et al. | 123/598 |
| 5,577,471 | | 11/1996 | Ward | 123/169 |
| 5,621,278 | * | 4/1997 | Chambers | 123/604 |
| 5,947,093 | * | 9/1999 | Ward | 123/604 |

FOREIGN PATENT DOCUMENTS

| | | |
|---|---|---|
| 56070099 | 5/1981 | (JP) . |
| 58179753 | 9/1983 | (JP) . |
| 60252168 | 12/1985 | (JP) . |
| 07264848 | 10/1995 | (JP) . |
| WO 97/21920 | 6/1997 | (WO) . |

* cited by examiner

*Primary Examiner*—John Kwon
(74) *Attorney, Agent, or Firm*—Sheridan Ross P.C.

(57) ABSTRACT

An ignition apparatus for a gasoline engine of independent cylinder type with low-voltage wiring has no distributor, and a CDI (Capacitor Discharge Ignitor) is employed to improve the ignition characteristic of lean mixture. In order to lengthen a discharge time of the ignition apparatus of CDI type, the primary winding of a transformer in series with a switching element is connected in parallel to a capacitor, the ends of which are connected to a DC power supply. The switching element includes an IGBT and a diode connected in parallel to each other.

8 Claims, 13 Drawing Sheets

IGNITION APPARATUS

BACKGROUND OF THE INVENTION

The present invention relates to an ignition apparatus of low-voltage wiring type for an engine using gasoline as a fuel.

In an automotive gasoline engine, it is widely utilized to supply lean mixture into the engine and combust it completely in order to meet the restrictions against environmental pollution. In the engine using the lean mixture, therefore, an accurate timing advance control is required over a wide range of ignition timing. In order to meet this requirement, a low-voltage wiring system has been put into practical use. In the low voltage wiring system, a distributor is eliminated and the ignition apparatus is arranged in each cylinder. Another advantage of the low-voltage wiring system is that the absence of a high-voltage wiring leads to a reduced trouble of the electrical system, and the wiring is simplified.

For an independent ignition apparatus to be arranged in each cylinder of a multicylinder engine, the ignition apparatus is required to be compact and slim. Under the circumstances, however, a conventional ignition apparatus which was combined with the distributor was used by reducing the size. Therefore, the efficiency was low and the reliability was not high.

A first prior art ignition apparatus will be explained with reference to a circuit configuration of the first prior art ignition apparatus shown in FIG. 10.

A primary winding 31 of a transformer (ignition coil) 3 is connected to a battery 1 through a switching element 2. An end of the secondary winding 32 of the transformer 3 is connected to the negative electrode of the battery 1, and the other end thereof is connected to a spark plug 33. FIG. 11A shows the current flowing in the switching element 2, and FIG. 11B a current in the secondary winding 32.

The switching element 2 is turned on/off by a control signal applied thereto from a controller not shown. Upon turning on of the switching element 2, a current flows through the battery 1, the primary winding 31 and the switching element 2 so that an electromagnetic energy is stored in the transformer 3. An on-period of the switching element is designated as $T_{on}$. At the time when the switching element 2 is turned off, the electromagnetic energy stored in the transformer 3 is represented by $(Cs \cdot Vs^2)/2$, where Cs is a distributed capacity of the secondary winding 32 and Vs is a secondary voltage. And when the switching element 2 turns off, the stored energy is transferred to the secondary side. As a result, the secondary voltage Vs rises to such an extent that plug gap 34 of a spark plug 34 breaks down and a discharge current flows. A transistor or a FET is generally used as the switching element 2.

A capacitor discharge ignitor (CDI) disclosed in JP-A-60-252168 is shown in FIG. 12 as a second prior art. FIG. 12 shows a circuit configuration of the CDI. A battery 1 and a spark plug 33 are substantially identical to those shown in FIG. 10. A DC-DC converter 4 in series with a capacitor 5 is connected between the positive terminal of the battery 1 and the primary winding 31 of the transformer 3. A switching element 2A is inserted between the junction point between the DC-DC converter 4 and the capacitor 5 and the negative terminal of the battery 1. The switching element 2A requires a high allowable pulse current value, and therefore generally is composed of a thyristor. FIG. 13A shows a current flowing in the switching element 2A, and FIG. 13B a discharge current flowing in the secondary winding 32.

In FIG. 12, the voltage across the battery 1 is converted to a high DC voltage (e.g. 400 v) by the DC-DC converter 4 and charges the capacitor 5. A pulse signal responding to an ignition timing is supplied to the gate of the switching element 2A from a controller not shown, and the switching element 2A turns on. A charge stored in the capacitor 5 is discharged through the switching element 2A and the primary winding 31 of the transformer 3. Thus, a high voltage is generated across the secondary winding 32, and a discharge current of FIG. 13B flows. The discharge current from the capacitor 5 assumes a resonance waveform determined by an equivalent inductance as viewed from the primary side of the transformer 3 and the capacitance of the capacitor 5. In order to turn off the thyristor positively in preparation for the next firing, it is a general practice to turn on the thyristor only during the positive half cycle and turn it off during the next negative half cycle. In the first conventional ignition apparatus, the transformer 3 has dual functions of storing the electromagnetic energy and boosting the voltage. As regards the energy storage, however, an inductance device have a low volume ratio as described below. The number of turns of the primary winding 31 is determined by the inductance required for the electromagnetic energy storage. Further, the requirement for a large step-up ratio greatly increases the number of turns of the secondary winding 32. As a result, the distributed inductance and the distributed capacitance are increased, thereby adversely affecting the energy transfer efficiency of the transformer.

Further, it is necessary to turn on the switching element 2 before the desired ignition timing. This timing is determined based on the information on the previous cycle. It is therefore difficult to control the turn-on timing accurately following the sudden change of the engine speed.

In the CDI system of the second prior art, the energy storage element is the capacitor 5. The capacitor 5 is smaller than the transformer 3 for the same energy storage, and therefore the energy storage element can be reduced in size. The transformer 3 is not required to store energy, and can be greatly reduced in size, because the magnetic saturation due to the exciting current is the sole matter of consideration. For example, the number of turns of the primary winding of the transformer in the second prior art is about one third of that in the first prior art. Thus the energy transfer efficiency is high. In view of the fact that the thyristor is used for the switching element 2A, however, the discharge time has to be shortened in order to prevent a firing error. Furthermore, since the switching element 2A is connected across the output terminal of the DC-DC converter 4 and the negative terminal of the battery 1, the battery 1 is shortcircuited by the on-state of the switching element 2A. Therefore, the on-period of the switching element 2A can not be extended. The low ignition accuracy, therefore, has been the problem for the lean mixture requiring a long discharge time, 0.5 milliseconds for example.

BRIEF SUMMARY OF THE INVENTION

An object of the present invention is to improve the capacitor discharge ignitor (CDI) and to provide a compact and highly reliable ignition apparatus of low-voltage wiring type which is long in discharge time and high in efficiency.

The ignition apparatus according to the present invention comprises a DC-DC converter connected to a DC power supply for converting the input DC voltage to a high DC voltage (e.g. 400 v), a capacitor connected to the output terminal of the DC-DC converter and charged by the output voltage of the DC-DC converter, a transformer including a primary winding with an end thereof connected to an end of the capacitor and a secondary winding connected to a spark plug, and switching means including an insulated gate bipolar transistor (IGBT) and a diode connected in inverse-parallelism and inserted between the other end of the primary winding and the other end of the capacitor.

When the switching means including the IGBT and the diode turns on, a resonance current of a frequency determined by the capacitance of the capacitor connected in parallel to the DC power supply and the inductance of the primary winding of the transformer flows in the capacitor and the primary winding of the transformer. The resonance current is gradually decreased in a time determined by the capacitance of the capacitor. A voltage generated in the secondary winding by the resonance current causes discharge at the spark plug. According to the present invention, the switching means is conneted between the aforementioned other end of the primary winding and the aforementioned other end of the capacitor. Therefore, the battery is not shortcircuited by on-state of the switching means, and the time length of on-period of the switching means is not restricted. Moreover, the time during which the resonance current decreases gradually can be set to the desired length by selecting the capacitance of the capacitor.

According to the present invention, the extension of the sustained discharge time which has been difficult in the conventional CDI system is made possible, and the efficiency of the ignition apparatus is improved. Thus, the system is improved in reliability and reduced in size and cost.

Further, since the on-period of the switching element can be adjusted, the ignition energy can be supplied to the spark plug at the required time in the required amount thereby further improving the efficiency. The prior art system has been configured such that the energy is not regulated but a very much large margin of energy was always provided in anticipation of the worst operating conditions, and therefore, extraneous energy is consumed in normal state. In contrast, according to this invention, minimum required energy is secured for a higher efficiency, and the system can be remarkably reduced in size.

DETAILED DESCRIPTION OF THE INVENTION

Hereafter, preferred embodiments of the present invention will be explained with reference to FIG. 1 to FIG. 9D.

[First Embodiment]

Figure 1:
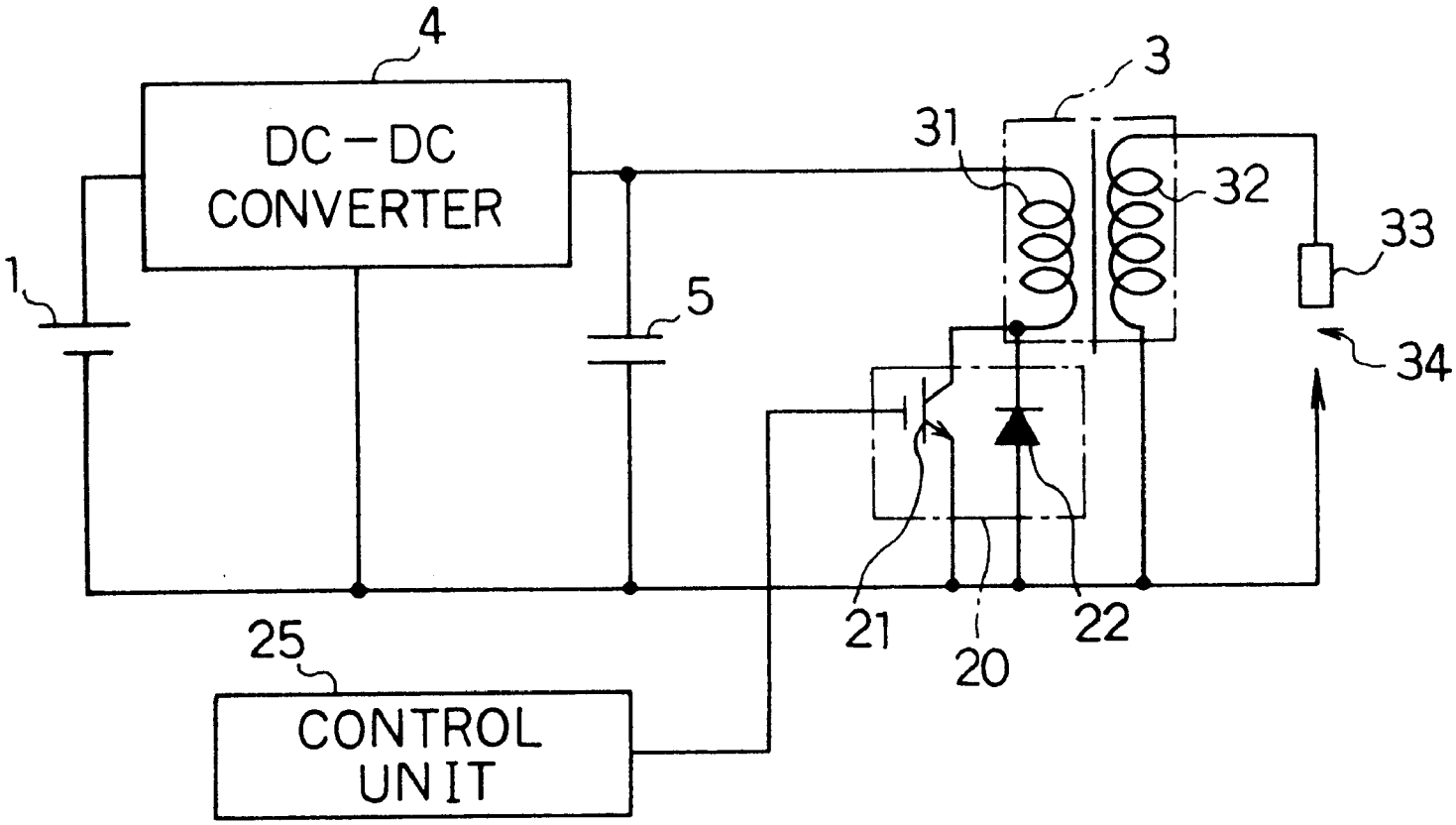
FIG. 1 is a circuit diagram of an ignition apparatus according to a first embodiment of the invention.
Figure 2A:
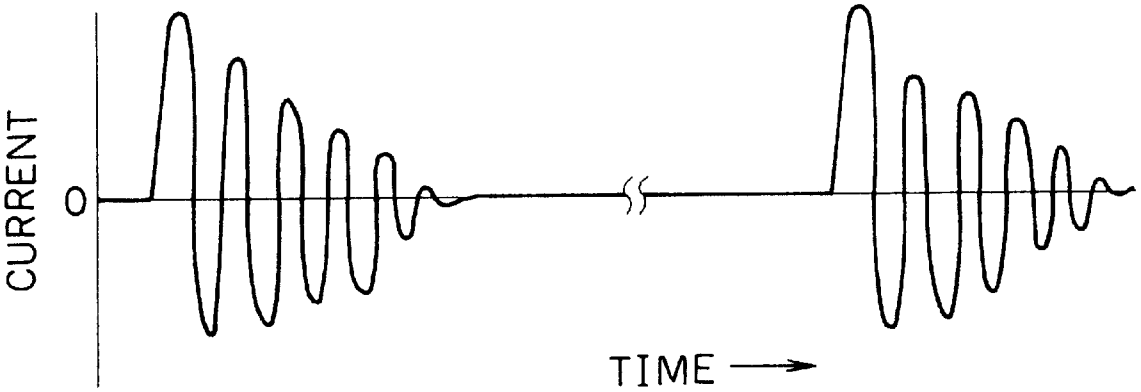
FIG. 2A and FIG. 2B are waveform diagrams showing the operation of the first embodiment of the invention.
Figure 2B:
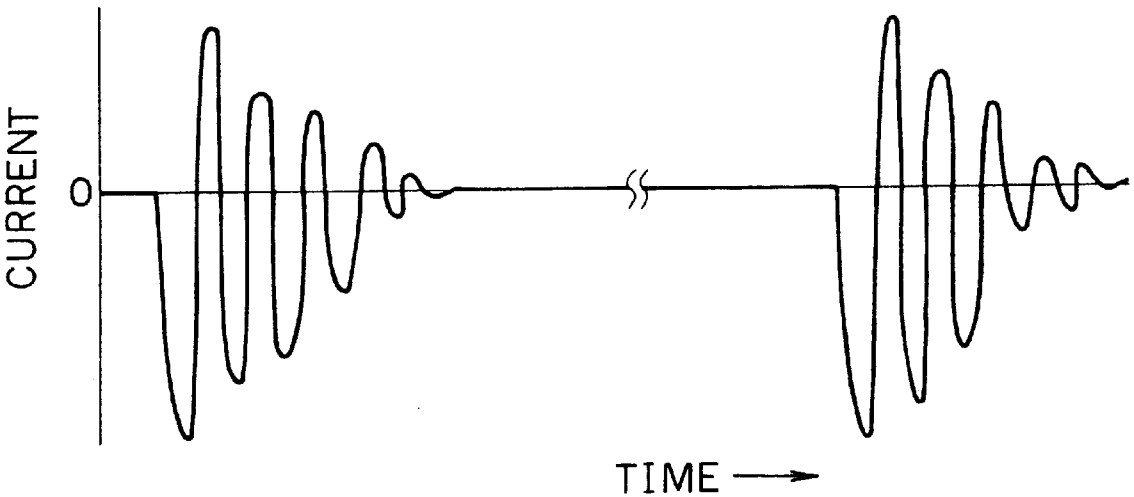

FIG. 1 is a circuit diagram of an ignition apparatus according to the first embodiment of the present invention. In FIG. 1, the positive electrode of a battery 1 is connected to an end of a primary winding 31 of a transformer (ignition coil) 3 through a DC-DC converter 4 for converting the input DC voltage to a high DC voltage (e.g. 400 v). The other end of the primary winding 31 is connected to the negative electrode of the battery 1 through a bi-directional switching element 20. The switching element 20 includes an IGBT 21 and a diode 22 connected in inverse-parallelism to the IGBT 21. The gate of the IGBT 21 is connected to a control unit 25, and a control signal is applied from the control unit 25 to the IGBT 21. A capacitor 5 is connected between the junction point between the DC-DC converter 4 and the primary winding 31 and the negative electrode of the battery 1. An end of a secondary winding 32 of the transformer 3 is connected to the negative electrode of the battery 1 and the other end thereof is connected to a spark plug 33. The turns of the secondary winding 32 is more than that of the primary winding 31. FIG. 2A shows a current flowing in the primary winding 31 through the switching element 20, and FIG. 2B shows a current flowing in the secondary winding 32.

In FIG. 1, as long as the gate of the IGBT 21 of the switching element 20 is supplied with an on-signal from the control unit 25, the switching element 20 is conducting in two directions. As a result, as shown in FIG. 2A, a discharge current at a resonance frequency determined by the capacitance of the capacitor 5 and an inductance as viewed from the primary side of the transformer 3 flows in the primary winding 31. The discharge begins when the voltage across the secondary winding 32 exceeds the breakdown voltage of a discharge gap 34 of the spark plug 33. During a time period (hereinafter is referred to as duration) when the voltage across the secondary winding 32 of the transformer 3 is not lower than the breakdown voltage of the discharge gap 34, the currents flowing in the primary winding 31 and the secondary winding 32 becomes a gradually-attenuating resonance waveform as shown in FIGS. 2A, 2B, respectively. The duration of the resonance waveform is dependent on the capacitance of the capacitor 5. Therefore, by appropriately selecting the capacitance, a desired duration is obtained. Consequently, the discharge time can be extended in the ignition apparatus for the engine using lean mixture. The electromagnetic energy in the transformer 3 is transmitted from the primary winding 31 to the secondary winding 32 and is consumed as discharge energy in the spark plug 33. When the voltage across the secondary winding 32 of the transformer 3 drops below the breakdown voltage of the discharge gap 34, the discharge ceases. According to the first embodiment, the discharge time period can be selected in the range of 0.4 to 0.6 msec. The lean mixture, therefore, can be ignited accurately.

[Second Embodiment]

Figure 3:
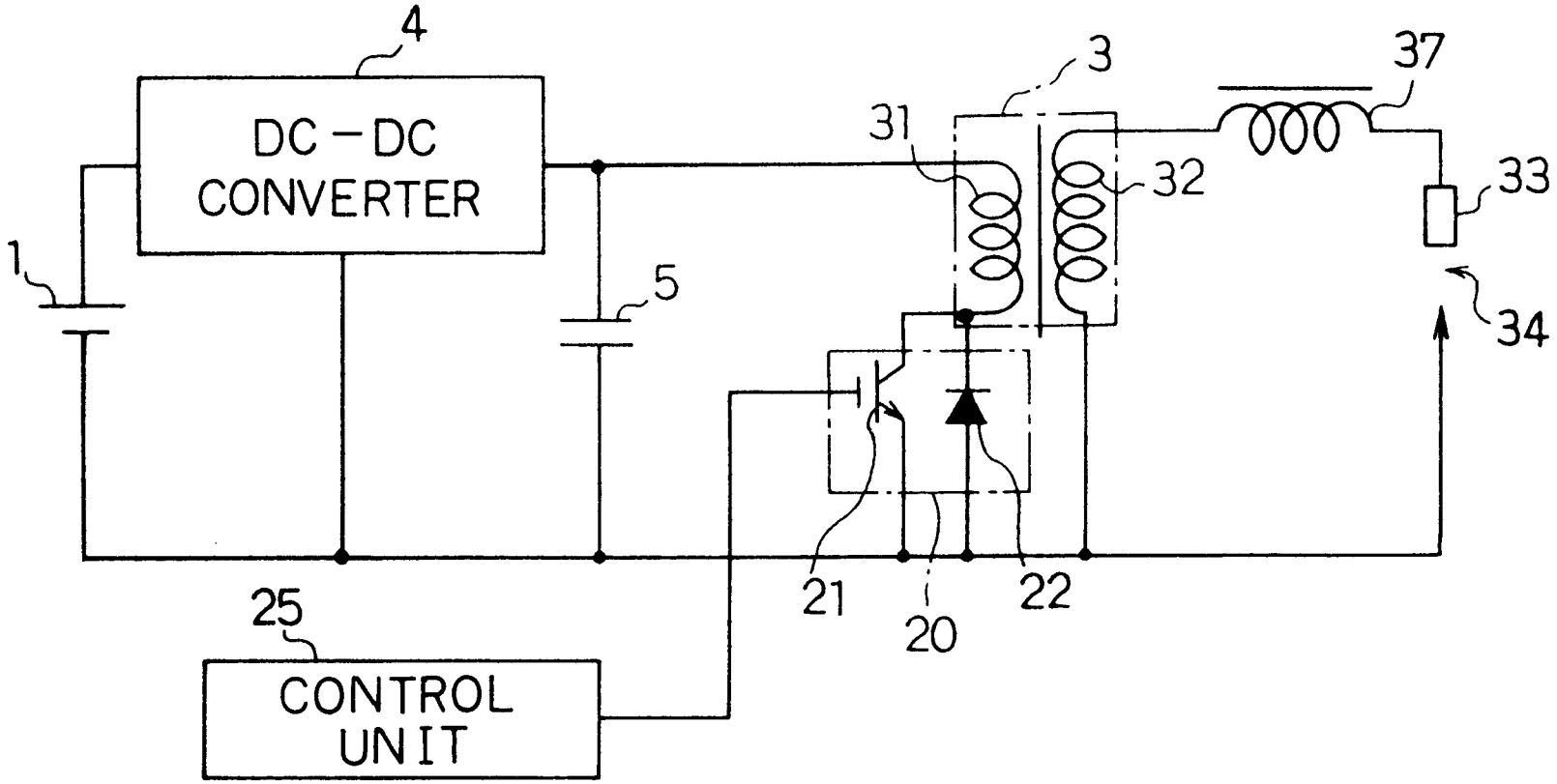
FIG. 3 is a circuit diagram showing an ignition apparatus according to a second embodiment of the invention.

A second embodiment of the invention will be described with reference to FIG. 3 and FIG. 4.

The discharge time can be further extended if the electromagnetic energy generated in the secondary winding 32 can be issued in the secondary side including the secondary winding 32 to a longer length of time. The inventor has found that this is possible by inserting a choke coil 37 in series with the secondary winding 32. FIG. 3 is a specific circuit diagram of the second embodiment of the invention comprising the choke coil 37. The configuration other than the choke coil 37 is identical to that of the first embodiment shown in FIG. 1 and will not be described. The provision of the choke coil 37 increases the discharge time by about 80 to 100%.

Figure 4A:
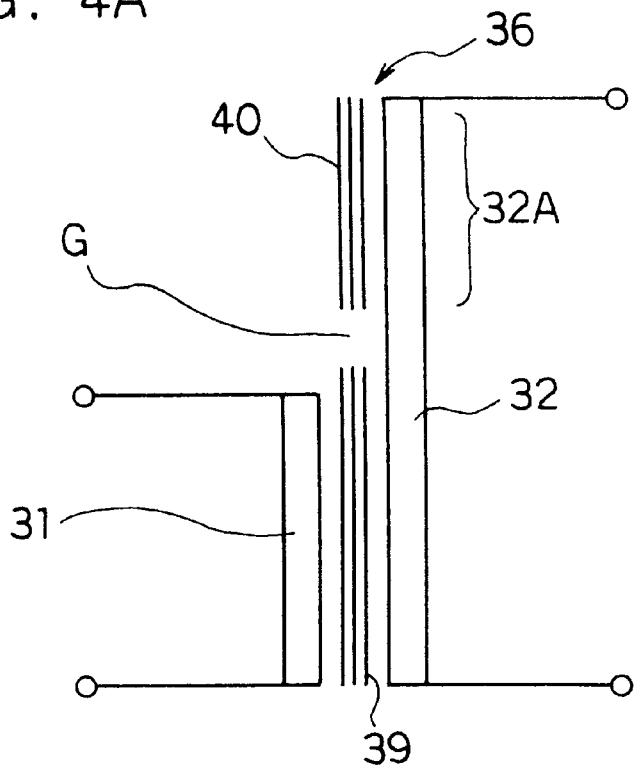
FIG. 4A is a diagram showing a configuration of the transformer according to the second embodiment of the invention.
Figure 4B:
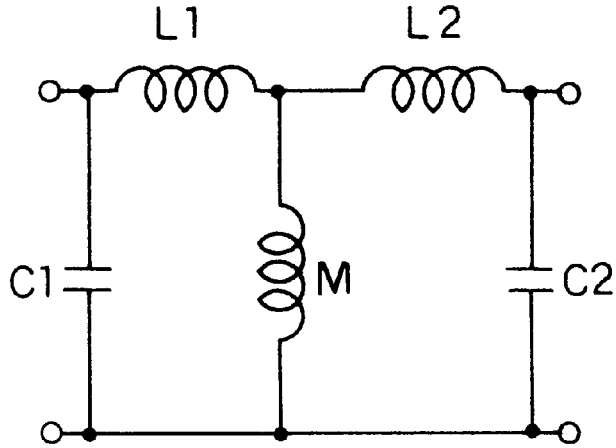
FIG. 4B is a diagram showing an equivalent circuit thereof.

In the case where it is difficult to arrange the choke coil 37 independently on the high-voltage side including the secondary winding 32, the same effect as if the choke coil 37 is inserted in the secondary side can be equivalently realized to some degree by changing the structure of the transformer 3. A specific example of such a structure is shown in FIG. 4A, and an equivalent circuit is shown in FIG. 4B. In FIG. 4A, the primary winding 31 and the greater proportion of the secondary winding 32 of a transformer 36 are wound in mutually overlapping relation to each other on an iron core 39 with the same winding width as far as possible in order to obtain a high coupling coefficient. A part 32A of the secondary winding 32 is wound on another iron core 40 disposed apart with an air gap G from the iron core 39.

The air gap G prevents the secondary winding 32 and the winding 32A from being totally coupled with each other magnetically, and has the same effect as if an independent choke coil is connected in series to the secondary winding 32. In such part of the iron core whereon the winding 32A only is wound is not always necessary. For instance, an air core has some effect in the case where the electromagnetic energy is sufficiently large.

In the equivalent circuit of FIG. 4B, "L1" represents a leakage inductance of the primary winding 31, "L2" represents a leakage inductance of the secondary winding 32, and "M" represents a mutual inductance. "C1" and "C2" represent stray capacitances. By adding the winding 32, the inductance L2 becomes larger in comparison with the inductance L1. An electromagnetic energy once transmitted to the secondary winding 32 does not easily transferred to the primary winding 31 by the action of the choke coil equivalently arranged in the secondary side. And consequently, the duration of discharge retention is extended.

Figure 12:
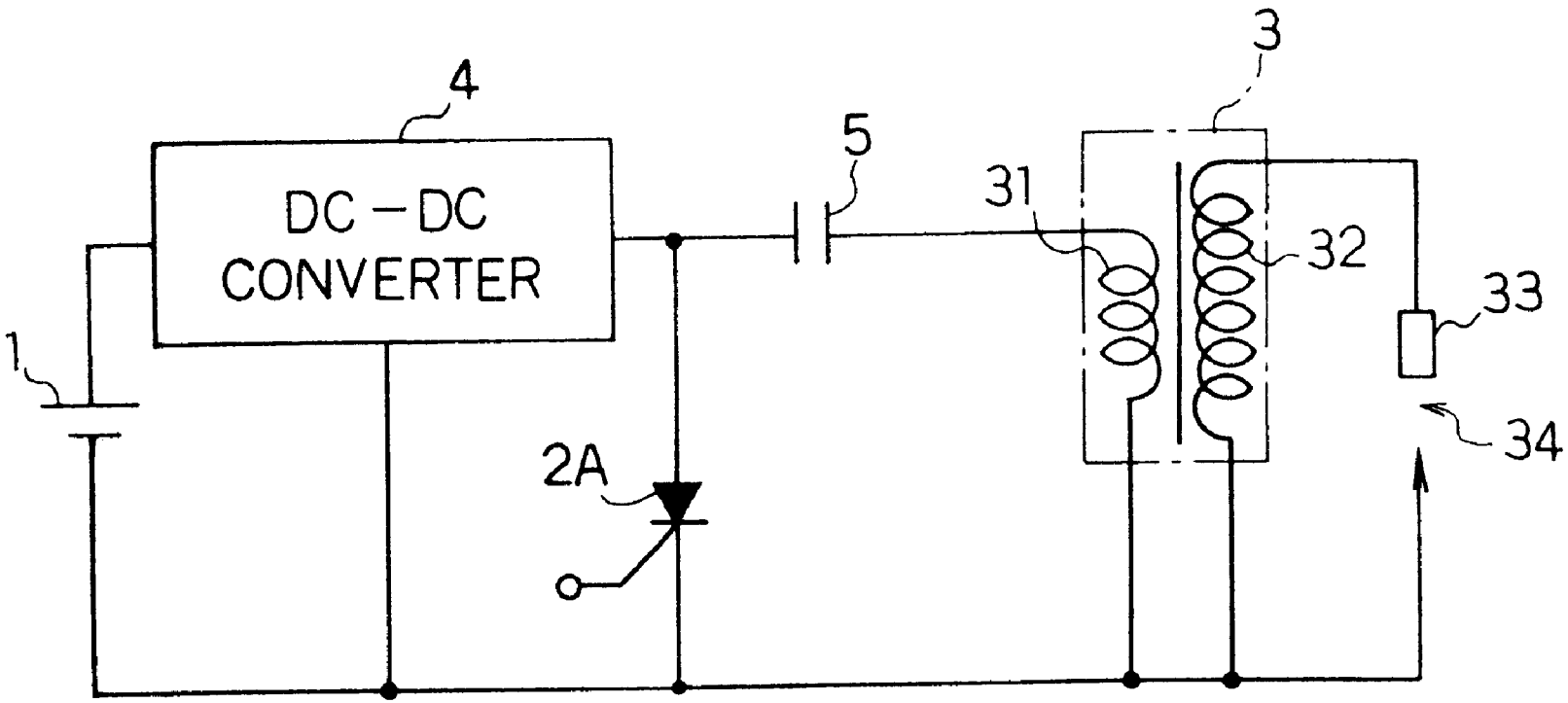
FIG. 12 (PRIOR ART)
FIG. 12 is a circuit diagram showing a second prior art ignition apparatus.
Figure 13A:
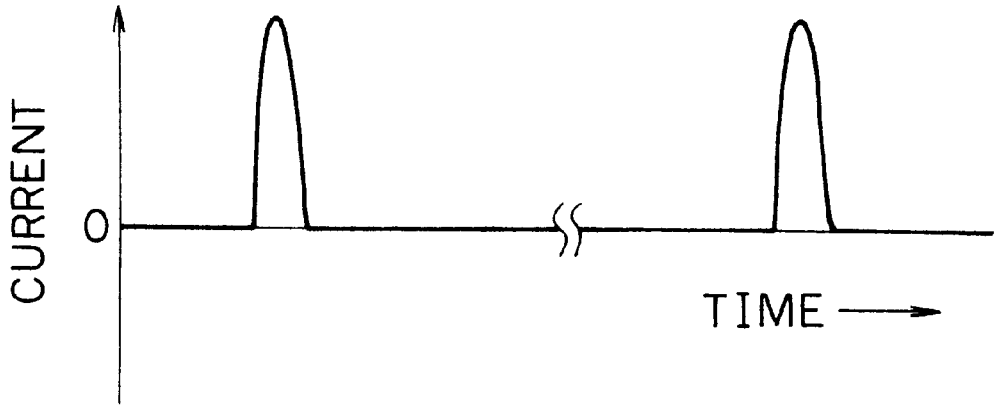
FIG. 13A (PRIOR ART)
FIG. 13A and FIG. 13B are waveform diagrams showing the operation of the second prior art ignition apparatus.
Figure 13B:
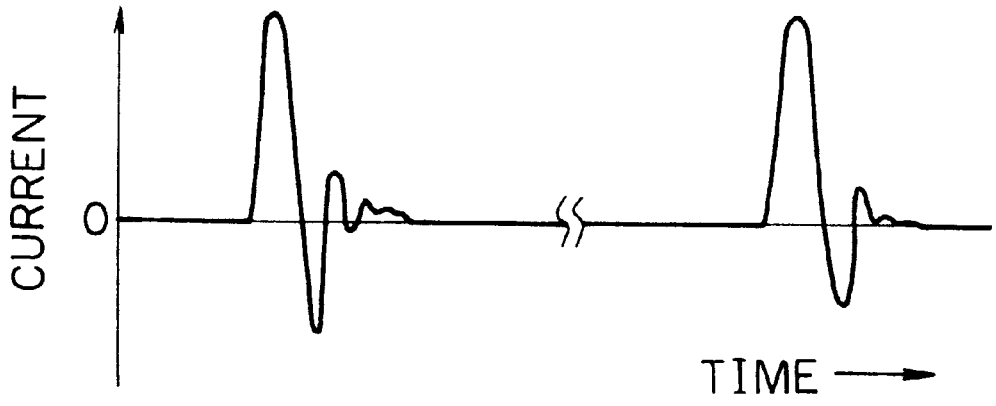
FIG. 13B (PRIOR ART)

According to the second embodiment, the CDI system having a very high energy transfer efficiency is combined with a transformer (ignition coil) having a large leakage inductance which is increased by the choke coil of the secondary side. Consequently, a compact and highly efficient ignition apparatus with a long discharge time can be realized. According to an experiment and a simulation test conducted by the inventor, the efficiency becomes about twice as high as that of the prior art shown in FIG. 12 with the same output energy and the discharge duration time.

[Third Embodiment]

Figure 5:
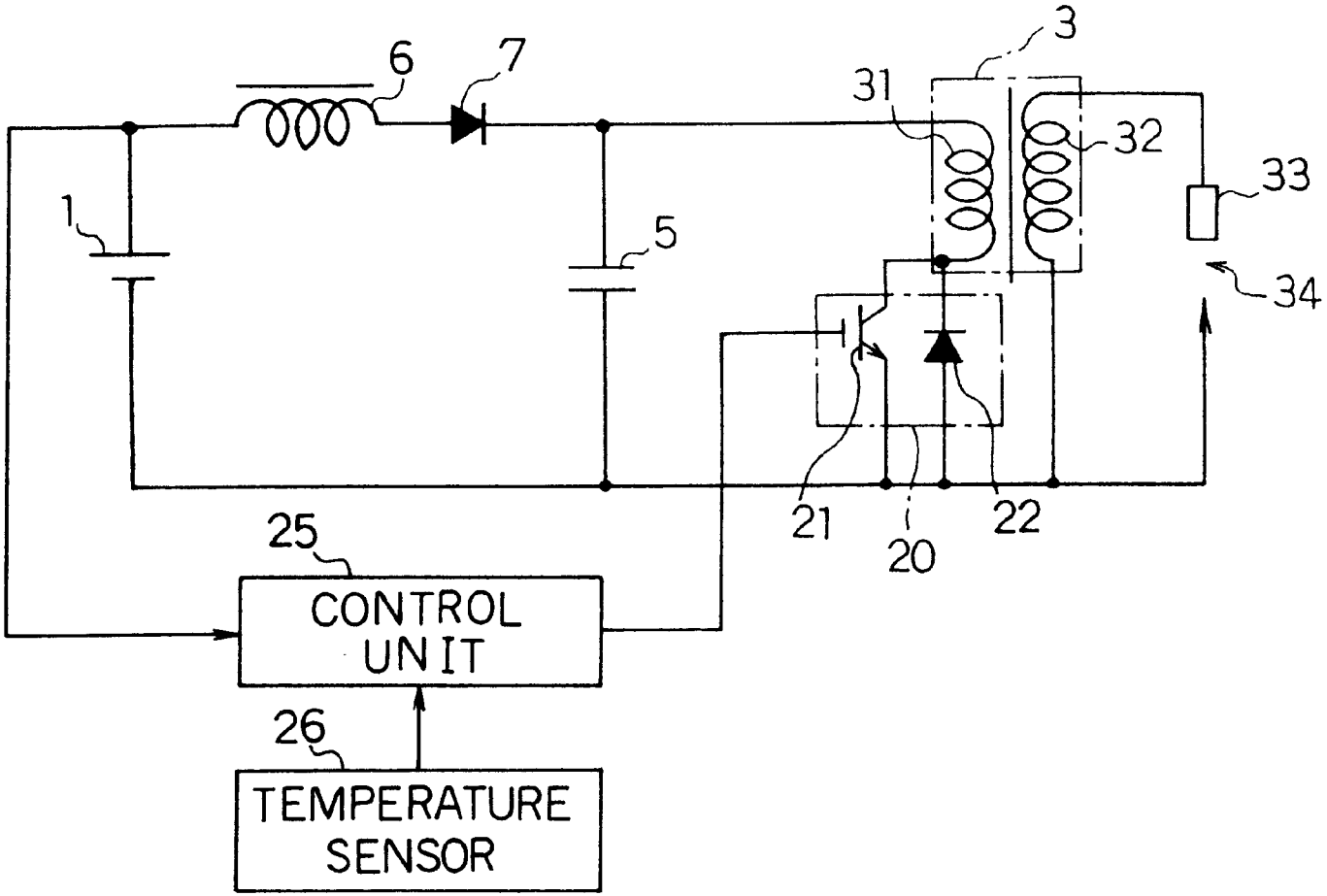
FIG. 5 is a circuit diagram showing an ignition apparatus according to a third embodiment of the invention.
Figure 6A:
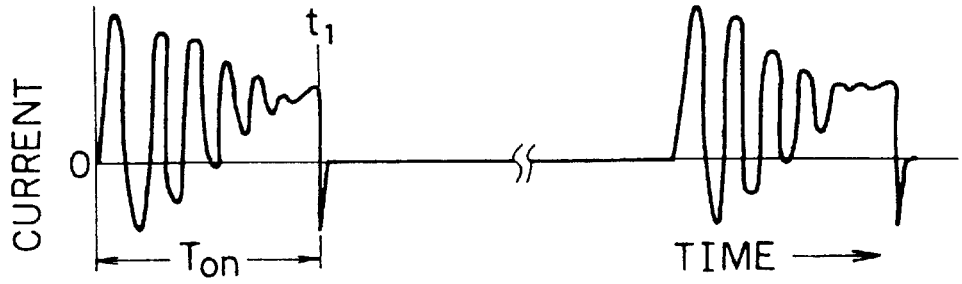
FIG. 6A to FIG. 6D are waveform diagrams showing the operation of the third embodiment.

FIG. 5 is a circuit diagram of an ignition apparatus according to a third embodiment of the invention. FIG. 6A shows waveform of a current flowing in a switching element 20 in FIG. 5, FIG. 6B waveform of a voltage across a capacitor 5, FIG. 6C a discharge waveform of a current flowing in a secondary winding 32, and FIG. 6D an input current waveform supplied from a battery 1. In the third embodiment, the DC-DC converter 4 of the first embodiment is replaced by a diode 7 connected in series with a choke coil 6. A temperature sensor 26 for detecting an ambient temperature is connected to the control unit 25. The configurations of the remaining component parts are similar to those of the first embodiment and will not be described.

Figure 6B:
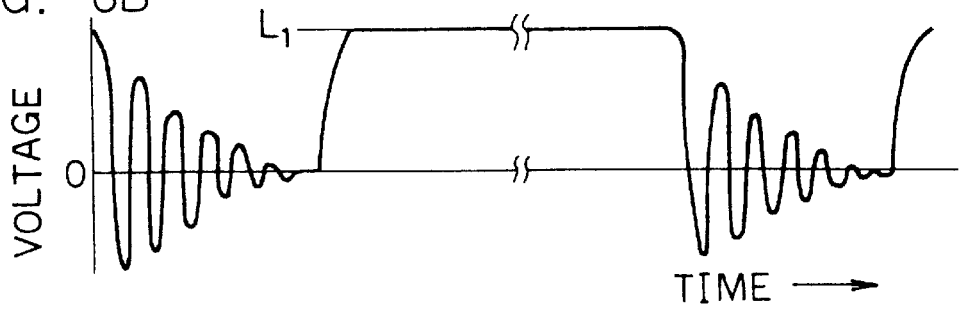

Upon turning on the switching element 20, the capacitor 5 begins to discharge. As shown in FIG. 6A, a discharge current flows for an on-period $T_{on}$ (in one example, 1–2 msec) while being attenuated as a resonance current determined by the capacitance of the capacitor 5 and the equivalent primary inductance of the transformer 3. The on-period $T_{on}$ is decided by a pulse width of a pulse signal which is applied to the gate of the IGBT 21 from the control unit 25. At the same time, a current flows also in the choke coil 6 so that an electromagnetic energy is stored therein. When the switching element 20 turns off at $t_1$, the electromagnetic energy in the choke coil 6 is discharged so as to charge the capacitor 5, and the voltage across the capacitor 5 increases to a predetermined level $L_1$ as shown in FIG. 6B. An experiment by the inventor shows that a voltage of about 350 V is generated by using the battery 1 of 13V, the choke coil 6 of 1 mH and the capacitor 5 of 1 $\mu$F with the switching element 20 having an on-period $T_{on}$ of 1 ms.

Figure 6C:
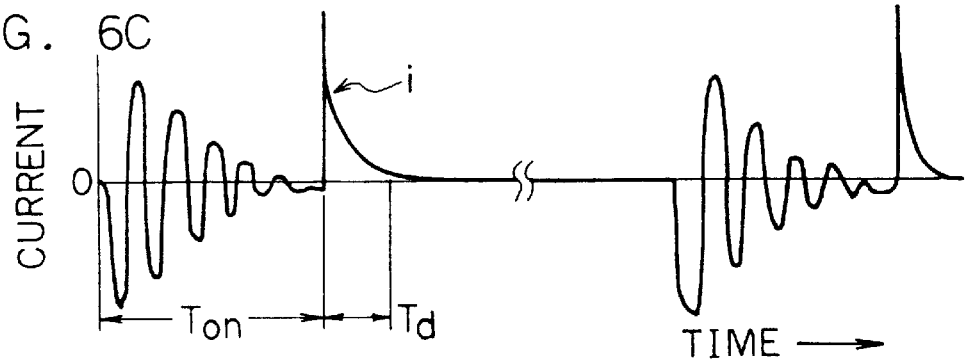
Figure 6D:
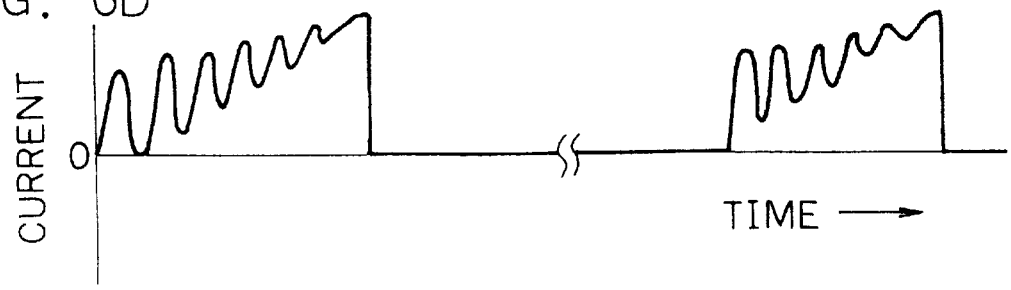

When the switching element 20 turns off, a high voltage is generated across the secondary winding 32 by a flyback effect due to the current flowing in the primary winding 31 of the transformer 3. When the high voltage exceeds the breakdown voltage of the spark plug 33, as shown in FIG. 6C, a DC discharge current i flows again in the secondary winding 32 of the transformer 3. As a result, a long discharge time is obtained which is the sum of the on-period $T_{on}$ of the switching element 20 and a period $T_d$ during which the discharge current flows in the secondary winding 32 by the flyback effect.

The third embodiment is based on the substantially same principle as that of the second embodiment from the view point that the electromagnetic energy is stored in the choke coil 6. The choke coil 37 in the second embodiment has a great number of turns for a high tension and therefore, a complicated insulation construction. On the contrary, the choke coil 6 in the third embodiment has a simple insulation construction because of a low operation voltage. Since a power loss in the choke coil 6 for the low operation voltage is smaller than that of the choke coil 37 for the high operation voltage, a high efficiency is realized in the third embodiment in comparison with the second embodiment.

In the ignition apparatus according to the third embodiment, the ignition energy is determined by the voltage across the capacitor 5. The voltage across the capacitor 5 depends on the current value of the choke coil 6 immediately before the switching element 20 turns off. Until the choke coil 6 is saturated, therefore, the current value is proportional to the on-period $T_{on}$ of the switching element 20. Specifically, the ignition energy can be regulated by controlling the on-period $T_{on}$. It is possible to maintain a constant ignition energy, for example, by controlling the on-period $T_{on}$ in accordance with the variations of the out put voltage of the battery 1. In the case where the energy required for ignition undergoes a change under the effect of an ambient temperature, the on-period $T_{on}$ is controlled to a suitable value in accordance with the ambient temperature detected by the temperature sensor 26. The on-period $T_{on}$ can be controlled responding to a rotation speed of an engine. As a result, extraneous energy consumption is suppressed while at the same time improving the reliability.

[Fourth Embodiment]

Figure 7:
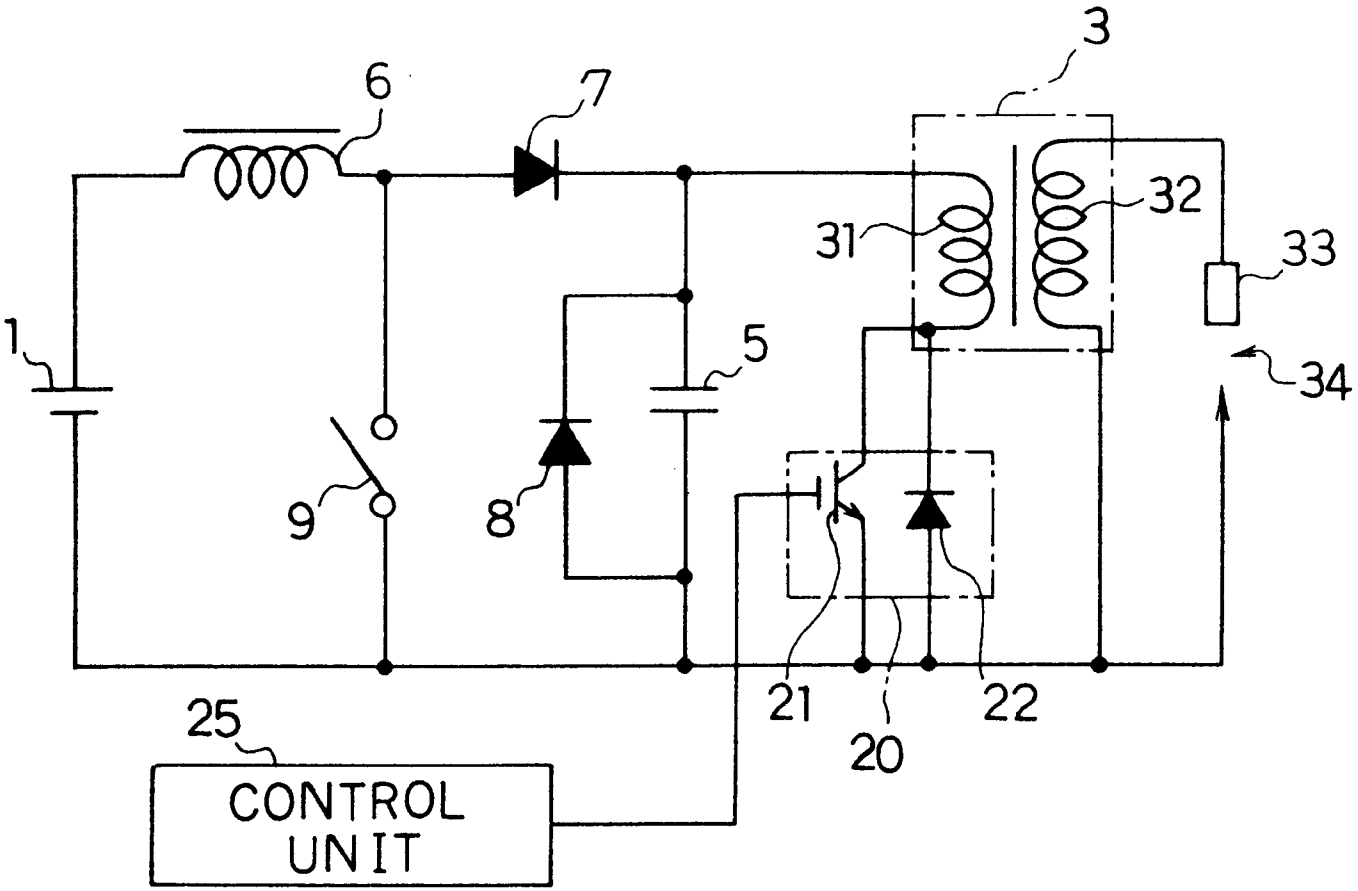
FIG. 7 is a circuit diagram showing an ignition apparatus according to a fourth embodiment of the invention.
Figure 8:
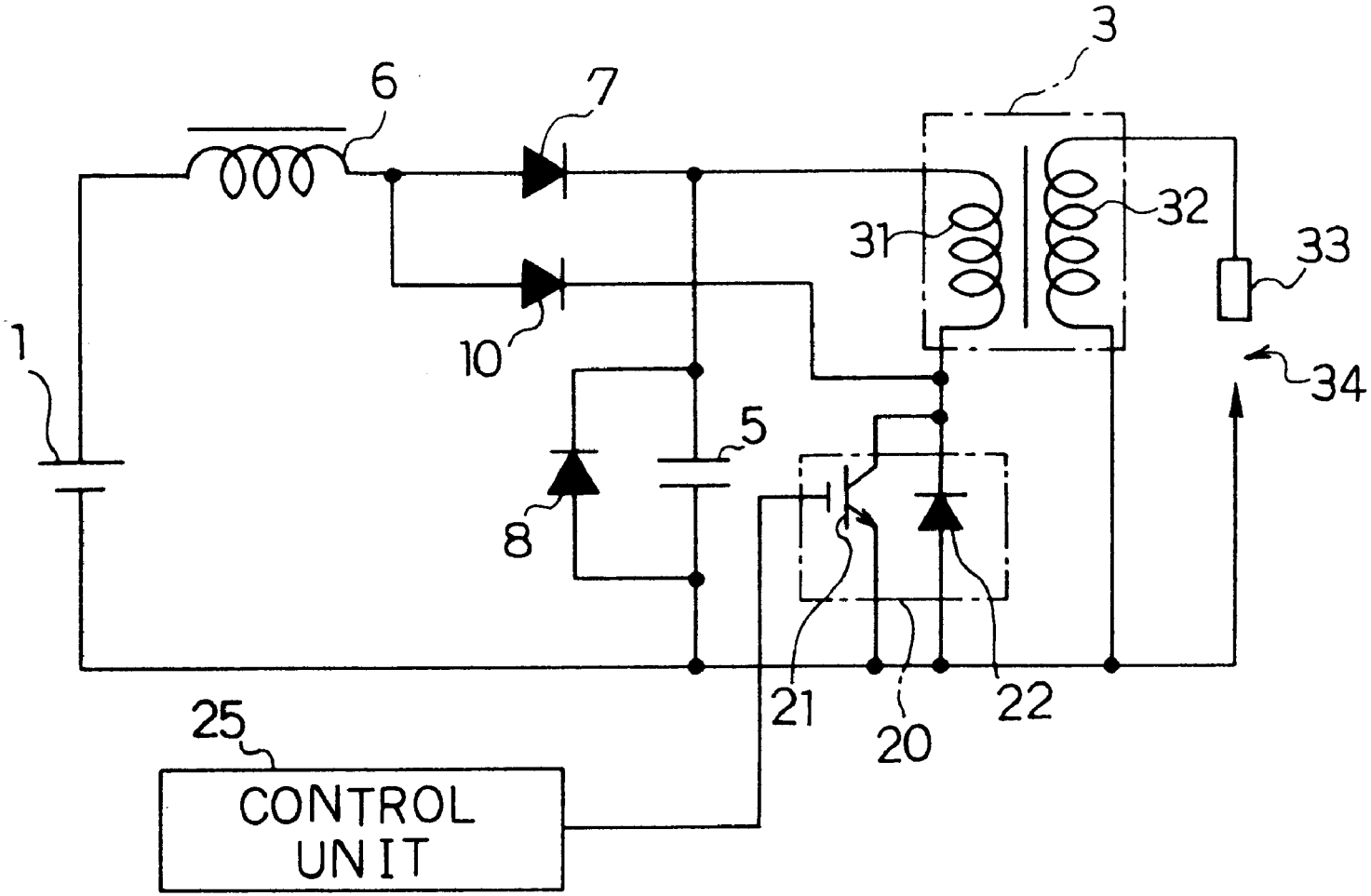
FIG. 8 is a circuit diagram showing an ignition apparatus according to a fifth embodiment of the invention.

FIG. 7 and FIG. 8 are circuit diagrams of an ignition apparatus according to a fourth embodiment of the invention. In the fourth embodiment, as described in detail below, an AC current flows continuously in the secondary winding 32 of the transformer 3 during both an on-period $T_{on}$ and an off-period $T_{off}$ of the switching element 20. Therefore, the discharge sustain time period can be freely set by repeating the on-off operation of the switching element 20 for a predetermined time period.

Figure 9A:
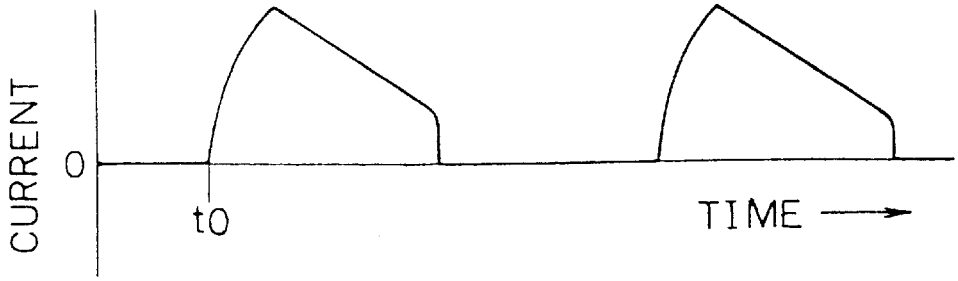
FIG. 9A to FIG. 9D are waveform diagrams showing the operation according to a fifth embodiment.
Figure 9B:
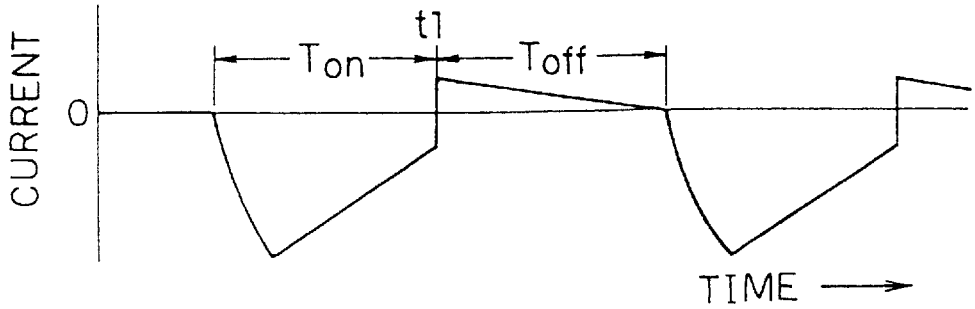
Figure 9C:
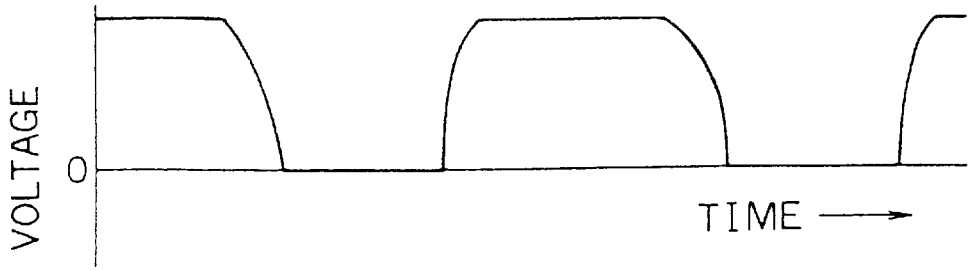
Figure 9D:
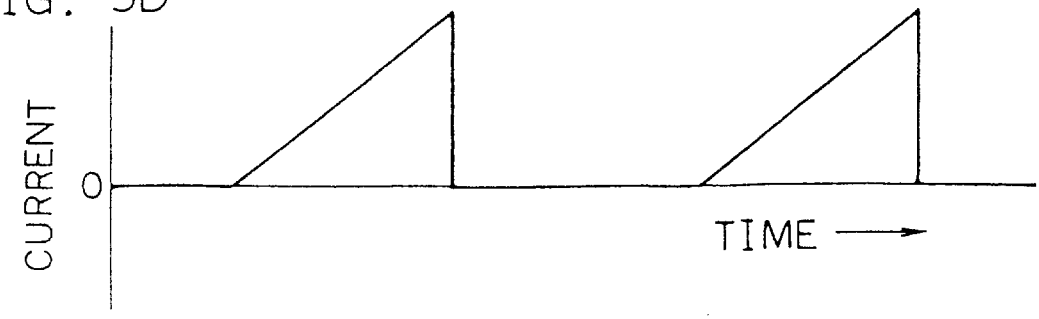
Figure 10:
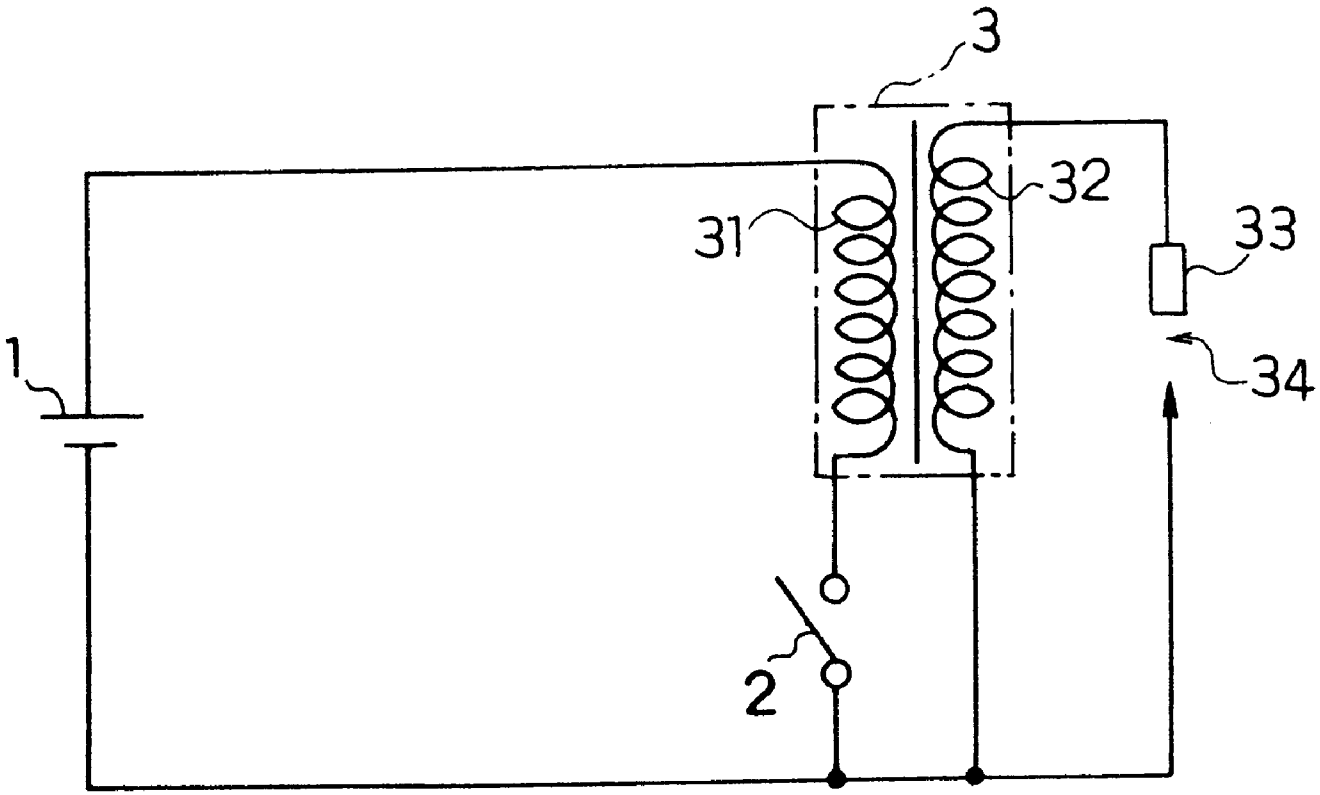
FIG. 10 (PRIOR ART)
FIG. 10 is a circuit diagram of a first prior art ignition apparatus.
Figure 11A:
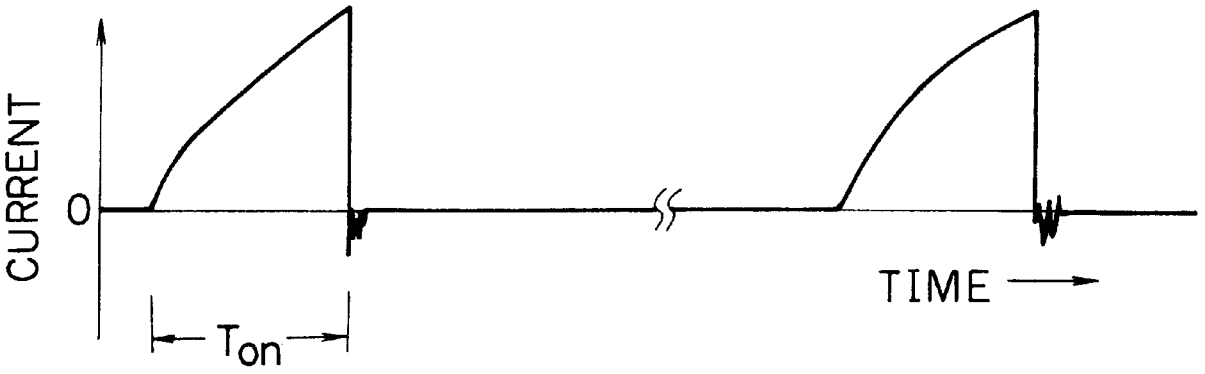
FIG. 11A (PRIOR ART)
FIG. 11A and FIG. 11B are waveform diagrams showing the operation of the first prior art ignition apparatus.
Figure 11B:
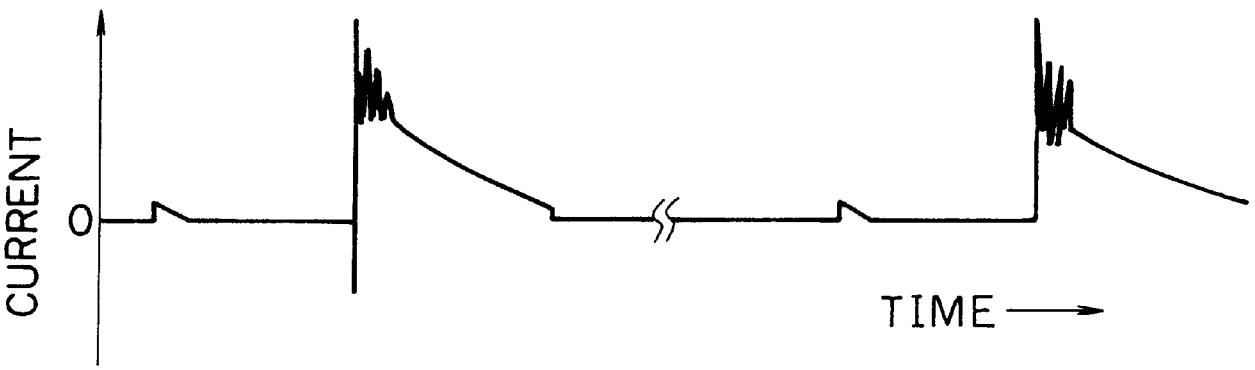
FIG. 11B (PRIOR ART)

In the fourth embodiment, the on-off operation of the switching element 20 is repeated by 20 to 30 times for one ignition operation. FIG. 9A shows waveform of a current flowing in the switching element 20. FIG. 9B shows waveform of a discharge current flowing in the secondary winding 32. Each on-period $T_{on}$ in FIG. 9B is about 100 μsec, and is one twentieth or one thirtieth of the on-period $T_{on}$ in FIG. 6A. FIG. 9C shows a voltage waveform across the capacitor 5, and FIG. 9D shows an input current waveform. According to FIG. 7, a diode 8 is connected in inverse-parallelism to the capacitor 5, and further, a switch 9 is connected across the junction between the choke coil 6 and the diode 7 and the negative electrode of the battery 1. The configurations and operations of the remaining parts are substantially similar to those of the third embodiment, and therefore the superposed descriptions thereof are omitted.

The switching element 20 and the switch 9 are turned on/off at the same time, namely in synchronism. Upon turning on of the switching element 20 at time t0, the capacitor 5 begins to discharge, so that a current flowing in the switching element 20 assumes the waveform as shown in FIG. 9A. After the current in the capacitor 5 reaches a peak, the current in the switching element 20 is gradually decreased due to clamping operation of the series circuit of the diode 8 and the switch 9. A discharge occurs and energy is discharged in the spark gap 34 connected to the secondary winding 32 of the transformer 3. As a result, a negative discharge current as shown in FIG. 9B flows for the on-period $T_{on}$ in the secondary winding 32 of the transformer 3. At a time point t1 while the absolute value of the current in the primary winding 31 of the transformer 3 gradually decreases, assume that the switching element 20 and the switch 9 turn off. The excitation energy remaining in the transformer 3 is discharged, and therefore a flyback voltage is generated in the secondary winding 32. Consequently, as shown in FIG. 9B, a gradually-decreasing positive discharge current flows during an off-period $T_{off}$ in opposite polarity to the on-period $T_{on}$. Also, the electromagnetic energy stored during the on-period $T_{on}$ of the switch 9 by the current flowing in the choke coil 6 is discharged when the switch 9 turns off. The capacitor 5 is charged again by the discharged energy. In this way, the voltage across the capacitor 5 rises to a predetermined level as shown in FIG. 9C.

By repeating this operation, the AC current can be continuously outputted in the secondary winding 32 of the transformer 3. It is also possible to freely select the sustained discharge time of the spark plug 33 connected to the secondary winding 32 of the transformer 3 by controlling the duration of the on-off operation of the switching element 20 and the switch 9.

Also, the electromagnetic energy stored in the choke coil 6 can be regulated by adjusting the on-period $T_{on}$ of the switching element 20 and the switch 9. In this way, the charge voltage of the capacitor 5 can be changed, thereby making it possible to control the discharge energy of the spark plug 33 connected to the secondary winding 32 of the transformer 3.

The on/off timings of the switching element 20 and the switch 9 are synchronized in the above-mentioned description. It does not necessarily require the synchronization of the switching element 20 and the switch 9. Specifically, the Switch 9 can be turned on either before or after turn-on of the switching element 20. Similarly, the switch 9 can be turned off at the same time as or after the switching element 20 is turned off. The discharge current waveform in the secondary winding 32 of the transformer 3 can be optimized by adjusting the on-period $T_{on}$ of the switching element 20. Also, both the excitation energy stored in the choke coil 6 and the charge voltage of the capacitor 5 can be regulated by adjusting the on-period $T_{on}$ of the switch 9.

In the case where the turning on/off of the switching element 20 and the switch 9 are completely synchronized with each other, as shown in FIG. 8, the diode 10 can be connected in forward direction across the junction point between the choke coil 6 and the diode 7 and the junction point between the secondary winding 31 and the switching element 20, instead of the switch 9. When connected in this way, the current in the choke coil 6 flows through the diode 10 and the switching element 20. As a result, a voltage drop occurs by an amount equal to the forward voltage of the diode 10, thereby unavoidably reducing the efficiency somewhat as compared with the circuit of FIG. 7. Since the control circuit for controlling the switch 9 is eliminated, however, the whole circuit can be simplified.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. An ignition apparatus comprising:

a series circuit including a choke coil and first switching means, said series circuit being connected across both terminals of a DC power supply, said first switching means repeating a plurality of turn-on and turn-off periods during one ignition operation;

a transformer including a primary winding connected at one end to the junction point between said choke coil and said first switching means through a forward direction diode, and a secondary winding connected to a spark plug, a parallel circuit including an opposite direction diode and a capacitor, said parallel circuit being connected across the junction point between said forward direction diode and the end of said primary winding and the junction point between said first switching means and said DC power supply; and second switching means connected between the other end of said primary winding and the junction point between said first switching means and said DC power supply, said second switching means repeating a plurality of turn-on and turn-off periods during one ignition operation.

2. An ignition apparatus in accordance with claim 1, wherein:

said first and second switching means are a parallel circuit including an IGBT and a diode connected in inverse-parallelism to said IGBT.

3. An ignition apparatus in accordance with claim 1, wherein:

the on-period of at least one of said first and second switching means is regulated in dependence on the voltage of said DC power supply.

4. An ignition apparatus in accordance with claim 1, wherein:

a temperature sensor for detecting an ambient temperature is further provided, and the on-period of at least one of said first and second switching means is regulated in dependence on the ambient temperature.

5. An ignition apparatus in accordance with claim 1, wherein:

the on-period of at least one of said first and second switching means is regulated in response to a rotation speed of an engine.

6. An ignition apparatus in accordance with claim 1, wherein:

a duration of on-off operation of at least one of said first and second switching means is regulated in dependence on the voltage of said DC power supply.

7. An ignition apparatus in accordance with claim 1, wherein:

a temperature sensor for detecting an ambient temperature is further provided, and a duration of on-off operation of at least one of said first and second switching means is regulated in dependence on the ambient temperature.

8. An ignition apparatus in accordance with claim 1, wherein:

a duration of on-off operation of at least one of said first and second switching means is regulated in dependence on the rotation speed of an engine.

* * * * *